US010358308B2

(12) United States Patent
Shiokawa et al.

(10) Patent No.: US 10,358,308 B2
(45) Date of Patent: Jul. 23, 2019

(54) SHEET FEEDING APPARATUS AND IMAGE FORMING APPARATUS

(71) Applicant: KONICA MINOLTA, INC., Chiyoda-ku, Tokyo (JP)

(72) Inventors: Yasuo Shiokawa, Hino (JP); Takahiro Okubo, Yokohama (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/696,294

(22) Filed: Sep. 6, 2017

(65) Prior Publication Data

US 2018/0072522 A1 Mar. 15, 2018

(30) Foreign Application Priority Data

Sep. 9, 2016 (JP) ..... 2016-176740

(51) Int. Cl.

| | |
|---|---|
| ***B65H 7/02*** | (2006.01) |
| ***B65H 5/06*** | (2006.01) |
| ***G03G 15/00*** | (2006.01) |

(52) U.S. Cl.

CPC ..... *B65H 7/02* (2013.01); *B65H 5/062* (2013.01); *G03G 15/5029* (2013.01); *G03G 15/6508* (2013.01); *G03G 15/6511* (2013.01); *G03G 15/70* (2013.01); *B65H 2404/1441* (2013.01); *B65H 2404/1442* (2013.01); *B65H 2407/21* (2013.01); *B65H 2511/224* (2013.01); *B65H 2511/416* (2013.01); *B65H 2515/112* (2013.01);

(Continued)

(58) Field of Classification Search

CPC ..... B65H 2404/144; B65H 2404/1441; B65H 2404/1442; B65H 5/062

See application file for complete search history.

(56) References Cited

U.S. PATENT DOCUMENTS 7,686,300 B2 * 3/2010 Watanabe ..... B65H 9/16 271/228
9,850,088 B2 * 12/2017 Maeda ..... B65H 9/004

(Continued)

FOREIGN PATENT DOCUMENTS

JP 02-132481 A 5/1990
JP 11-059952 3/1999

(Continued)

OTHER PUBLICATIONS

European Search Report dated Jan. 16, 2018, issued by the European Patent Office in corresponding European Patent Application No. 17187993.5-1022 (9 Pages).

(Continued)

*Primary Examiner* — Patrick Cicchino

(74) *Attorney, Agent, or Firm* — Buchanan Ingersoll & Rooney PC

(57) ABSTRACT

A sheet feeding apparatus, including: a pair of sheet feeding rollers; a pair of conveyance rollers; and a controller, wherein when a first condition regarding a sheet position is fulfilled in the sheet feeding, the controller makes one of the first conveyance roller and the second conveyance roller move in a direction opposite to the other conveyance roller and when a second condition regarding the sheet position is fulfilled in the sheet feeding, the controller makes the one conveyance roller move in a direction toward the other conveyance roller.

11 Claims, 6 Drawing Sheets

(52) U.S. Cl.
CPC ..... *B65H 2701/1311* (2013.01); *B65H 2701/1313* (2013.01)

(56) References Cited

U.S. PATENT DOCUMENTS

| | | | | |
|---|---|---|---|---|
| 2005/0035539 | A1* | 2/2005 | Hashimoto | B65H 9/002 271/265.01 |
| 2008/0073833 | A1 | 3/2008 | Ono et al. | |
| 2008/0251998 | A1* | 10/2008 | Muneyasu | B65H 5/34 271/227 |
| 2010/0296856 | A1* | 11/2010 | Moriyama | B41J 3/60 400/642 |
| 2013/0214482 | A1* | 8/2013 | Matsumoto | B65H 7/10 271/228 |
| 2013/0320616 | A1* | 12/2013 | Nakagaki | B65H 9/004 271/227 |
| 2017/0158446 | A1* | 6/2017 | Okubo | G03G 15/6561 |

FOREIGN PATENT DOCUMENTS

| | | |
|---|---|---|
| JP | 2014-177335 | 9/2014 |
| JP | 2014-177335 A | 9/2014 |

OTHER PUBLICATIONS

Office Action (Communication pursuant to Article 94(3) EPC) dated Aug. 13, 2018, by the European Patent Office in corresponding European Patent Application No. 17187993.5. (6 pages).

Notification of the First Office Action dated Mar. 4, 2019 by the China National Intellectual Property Administration in corresponding Chinese Patent Application No. 201710804241.5 and English translation of the Office Action. (15 pages).

Office Action (Communication pursuant to Article 94(3) EPC) dated Mar. 21, 2019 by the European Patent Office in corresponding European Patent Application No. 17187993.5. (4 pages).

* cited by examiner

FIG.10

| | BASIS WEIGHT | PRESSING/SEPARATING |
|---|---|---|
| REGULAR PAPER | 64~80 | × |
| | 81~176 | × |
| | 177~216 | △ |
| | 217~256 | △ |
| | 257~300 | △ |
| | 301~450 | ○ |
| COATED PAPER | 64~80 | × |
| | 81~176 | × |
| | 177~216 | △ |
| | 217~256 | △ |
| | 257~300 | ○ |
| | 301~450 | ○ |

FIG.11

| | BASIS WEIGHT | UP/DOWN MOVEMENT | LEVEL |
|---|---|---|---|
| REGULAR PAPER | 64~80 | × | - |
| | 81~176 | × | - |
| | 177~216 | △ | SMALL AMOUNT OF PRESSURE REDUCTION |
| | 217~256 | △ | LARGE AMOUNT OF PRESSURE REDUCTION |
| | 257~300 | △ | COMPLETELY SEPARATED |
| | 301~450 | ○ | COMPLETELY SEPARATED |
| COATED PAPER | 64~80 | × | - |
| | 81~176 | × | - |
| | 177~216 | △ | SMALL AMOUNT OF PRESSURE REDUCTION |
| | 217~256 | △ | LARGE AMOUNT OF PRESSURE REDUCTION |
| | 257~300 | ○ | COMPLETELY SEPARATED |
| | 301~450 | ○ | COMPLETELY SEPARATED |

SHEET FEEDING APPARATUS AND IMAGE FORMING APPARATUS

BACKGROUND

1. Technological Field

The present invention relates to a sheet feeding apparatus and an image forming apparatus provided with the sheet feeding apparatus.

2. Description of the Related Art

Traditionally, there is known an electrophotographic type image forming apparatus in which a toner image is formed by developing an electrostatic latent image formed on a photoreceptor with toner, the formed toner image is transferred onto a sheet and the transferred toner image is heated to be fixed on a sheet to form an image on the sheet.

The above described image forming apparatus is generally provided with a manual feed tray which is intended for feeding small amount of sheets and various types of media. Usually, in order to feed various types of media from a manual feed tray, the conveyance path continuing from the manual feed tray is formed so that sheets can be conveyed in a straight manner as much as possible to reduce resistance.

However, in the case where the conveyance path that continues from the manual feed tray is preferentially formed in a straight line, there is a need to form the apparatus in a large size considering the balance with other conveyance paths such as the conveyance paths continuing from PFU (Paper Feeder Unit) and LU (large capacity sheet feeder unit).

In view of the above, by bending the conveyance path that continues from the manual feed tray, it has been attempted to form the apparatus in a small size while allowing various types of media to be fed.

In recent years, there has been increasing requests for improving the handling performance of media (especially, thick paper) and a swift action needs to be taken with respect to the need for feeding sheets having high rigidity comparing to traditional sheets.

In view of the above, as for the technique to improve the conveying performance of sheets, there is disclosed a technique which can suppress the increasing load caused on a sheet during its conveyance by releasing the nip part by making the first conveyance roller separate from the second conveyance roller when the sheet is thicker than a predetermined thickness (for example, see JP 2014-177335).

However, the technique described in JP 2014-177335 is for reducing the load caused on a sheet during its conveyance on the straight conveyance path and is not for suppressing the JAM (paper jam) which occurs when the front edge of a sheet (especially, a sheet having high rigidity) does not enter the conveyance nip part formed by the conveyance rollers pressing against each other due to bending of the conveyance path or the like, for example. Further, since the technique described in JP 2014-177335 focuses on reducing the load caused on a sheet during its conveyance, there is a problem that the strength to press a sheet at the nip part becomes weak and the strength for conveying the sheet is reduced.

SUMMARY

The present invention has been made in consideration of the above matters, and a main object of the present invention is to provide a sheet feeding apparatus which can suppress the occurrence of paper jams by reducing the load caused on a sheet during its conveyance and ensure the sheet conveyance strength even on a conveyance path which is bent and an image forming apparatus which includes the sheet feeding apparatus.

To achieve at least one of the abovementioned objects, according to an aspect of the present invention, a sheet feeding apparatus reflecting one aspect of the present invention includes a sheet feeding apparatus, including: a pair of sheet feeding rollers which is disposed on an upstream side of a bending path in a conveyance direction and sends out a sheet that is placed on a manual feed tray; a pair of conveyance rollers which is disposed on a downstream side of the bending path in the conveyance direction, includes a first conveyance roller and a second conveyance roller, and forms a conveyance nip part by making the first conveyance roller and the second conveyance roller press against each other and sends out the sheet which is sent from the pair of sheet feeding rollers; and a controller which controls sheet feeding of the sheet that is placed on the manual feed tray, wherein when a first condition regarding a sheet position is fulfilled in the sheet feeding, the controller makes one of the first conveyance roller and the second conveyance roller move in a direction opposite to the other conveyance roller and when a second condition regarding the sheet position is fulfilled in the sheet feeding, the controller makes the one conveyance roller move in a direction toward the other conveyance roller.

BRIEF DESCRIPTION OF THE DRAWINGS

The advantages and features provided by one or more embodiments of the invention will become more fully understood from the detailed description given hereinafter and the appended drawings which are given by way of illustration only, and thus are not intended as a definition of the limits of the present invention:

FIG. 10 is an example of a table in which sheet type conditions of sheets and whether pressing/separating operation of the upper conveyance roller is to be carried out are corresponding to each other; and FIG. 11 is an example of a table in which sheet type conditions of sheets, whether upward/downward movement of the upper conveyance roller is to be carried out and raising levels of the upper conveyance roller during the upward/downward movement are corresponding to each other.

DETAILED DESCRIPTION OF EMBODIMENTS

Hereinafter, one or more embodiments of the present invention will be described in detail with reference to the drawings. However, the scope of the invention is not limited to the disclosed embodiments.

Figure 1:
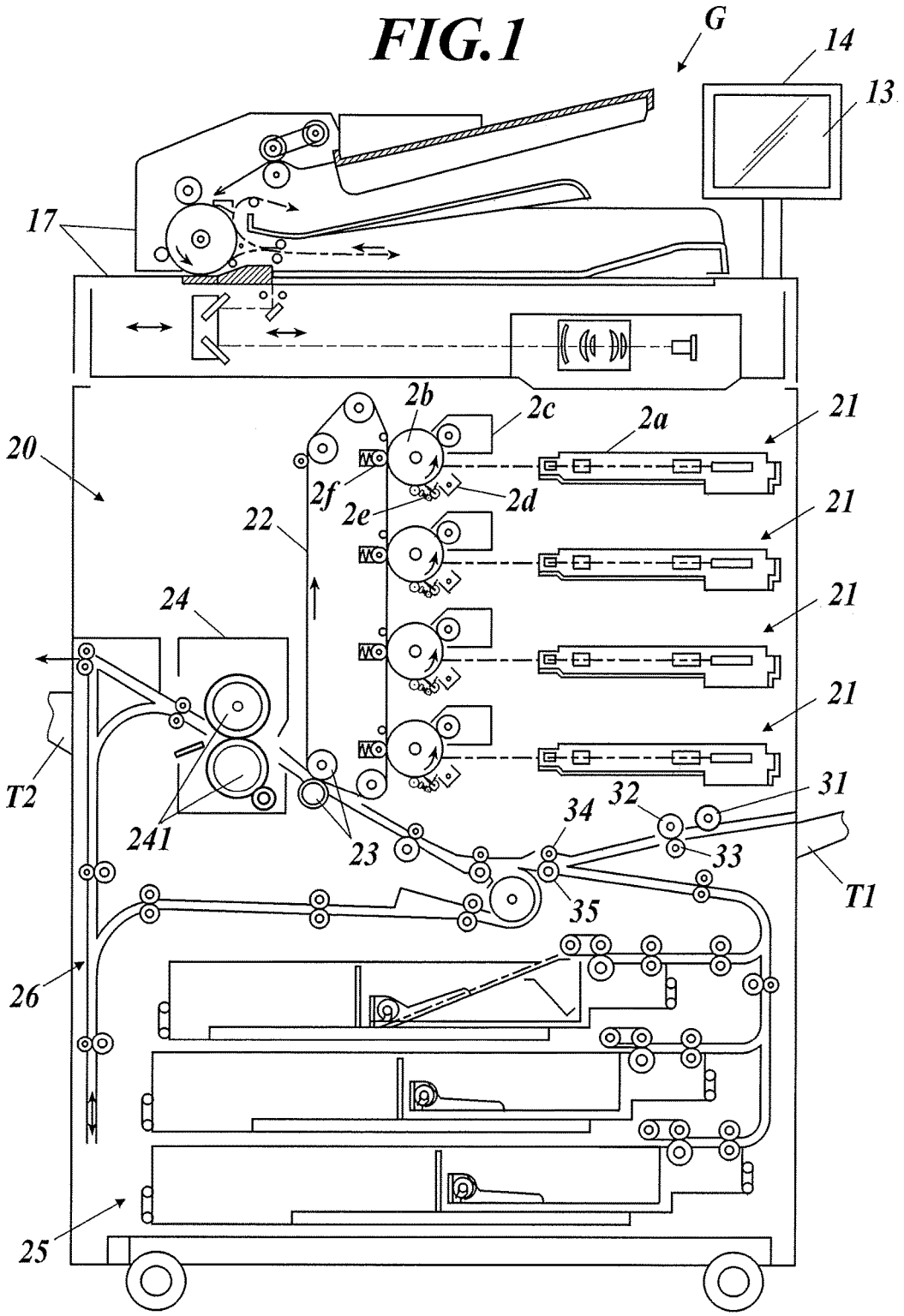
FIG. 1 is a front view showing an outline configuration of an image forming apparatus according to the embodiment.

As shown in FIG. 1, an image forming apparatus G according to the embodiment includes an image forming unit 20 (image former). An image is formed on a sheet by using color materials such as toner or the like in the image forming unit 20.

Figure 2:
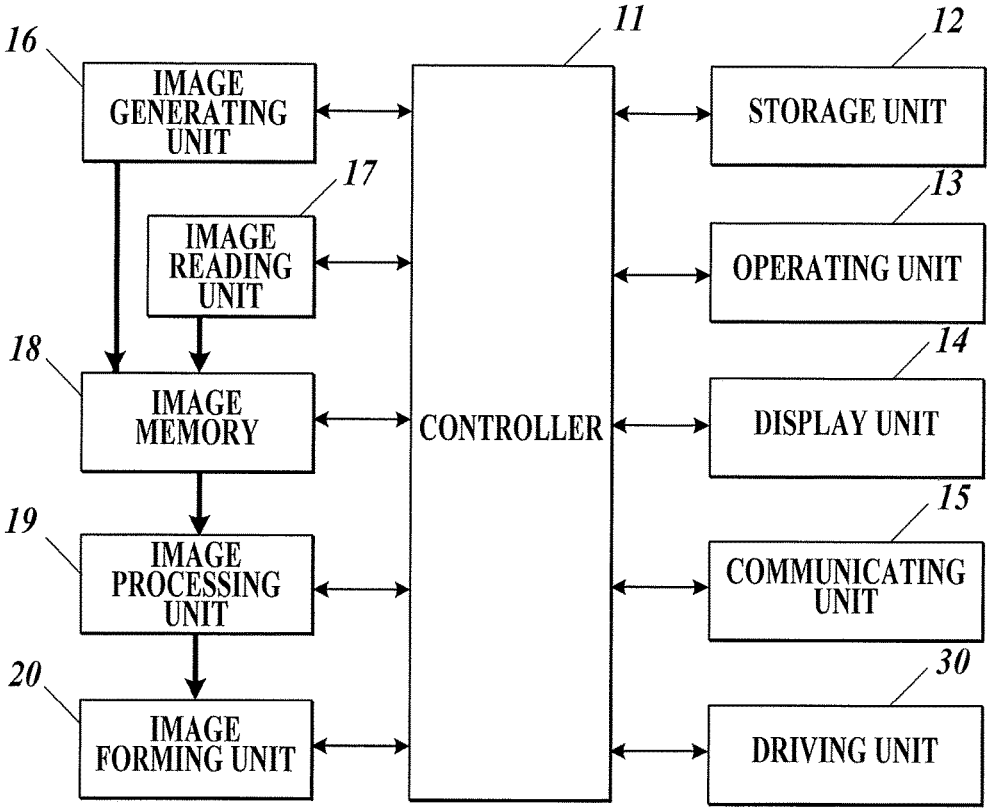
FIG. 2 is a functional block diagram showing a controlling mechanism of the image forming apparatus according to the embodiment.

As shown in FIGS. 1 and 2, the image forming apparatus G includes a controller 11, a storage unit 12, an operating unit 13, a display unit 14, a communicating unit 15, an image generating unit 16, an image reading unit 17, an image memory 18, an image processing unit 19, the image forming unit 20 and a driving unit 30.

The controller 11 includes a CPU, a RAM and the like. The controller 11 controls the individual units by reading out various types of programs from the storage unit 12 and executing them.

For example, the controller 11 makes the image processing unit 19 carry out image processing on an original image which is generated by the image generating unit 16 or the image reading unit 17 and stored in the image memory 18 and then, the controller 11 further makes the image forming unit 20 form an image on a sheet on the basis of the original image to which the image processing is already carried out.

In the storage unit 12, programs which can be read by the controller 11, files which are to be used when executing the programs and the like are stored. As for the storage unit 12, a large capacity memory such as a hard disk can be used.

As shown in FIG. 1, the operating unit 13 and the display unit 14 are provided at the upper part of the image forming apparatus G as the user interfaces.

The operating unit 13 generates an operation signal corresponding to the operation made by a user and outputs the operation signal to the controller 11. As for the operating unit 13, a key pad, a touch panel which is formed integrally with the display unit 14 or the like can be used.

In the display unit 14, an operating screen and the like are to be displayed according to the instruction from the controller 11. As for the display unit 14, a LCD (Liquid Crystal Display), an OELD (Organic Electro Luminescence Display) or the like can be used.

The communicating unit 15 communicates with external apparatuses on the network such as a user's terminal, a server, other image forming systems and the like, for example.

The communicating unit 15 receives vector data in which the content of instruction for forming an image is described in the page description language (PDL) from a user's terminal via the network.

The image generating unit 16 rasterizes the vector data which is received by the communicating unit 15 and generates an original image in a bitmap form. With respect to the original image, each pixel includes pixel values of four colors which are C (cyan), M (magenta), Y (yellow) and K (black). Pixel values are data values indicating the grayscale of an image and for example, the 8 bit data value expresses the grayscale in 0 to 255 tones.

As shown in FIG. 1, the image reading unit 17 includes an automatic sheet feeder, a scanner and the like. The image reading unit 17 reads the side of the document which is set on the document platen and generates an original image in a bitmap format. With respect to the original image which is generated by the image reading unit 17, each pixel includes pixel values of three colors which are R (red), G (green) and B (blue). Color conversion is carried out on the original image by a color converter (not shown in the drawings) so that the original image be converted into the original image having pixel values of four colors which are C, M, Y and K.

The image memory 18 is a buffer memory in which the original image generated by the image generating unit 16 or the image reading unit 17 is temporarily stored. As for the image memory 18, a DRAM (Dynamic RAM) or the like can be used.

The image processing unit 19 reads out the original image from the image memory 18 and carries out image processing such as gray level correction, halftone processing and the like on the original image.

Gray level correction is a process to convert the pixel values of individual pixels in the original image into corrected pixel values so that the gray level of the image formed on a sheet match the target gray level.

Halftone processing is a process to reproduce halftones in a pseudo manner and for example, is an error diffusion process, a screen process using the systematic dither method and the like.

The image forming unit 20 forms an image of four colors which are C, M, Y and K on a sheet in accordance with the pixel values of four colors of each pixel in the original image on which image processing is carried out by the image processing unit 19.

As shown in FIG. 1, the image forming unit 20 includes four writing units 21, an intermediate transfer belt 22, a pair of secondary transfer rollers 23, a fixing device 24, sheet feeding trays 25, a manual sheet feeding tray (hereinafter, referred to as a manual feed tray) T1, a sheet output tray T2 and the like.

The four writing units 21 are disposed in tandem along the belt surface of the intermediate transfer belt 22. The four writing units 21 form color images of C, M, Y and K. The only difference among the writing units 21 is that they form images of different colors, and they have the same configuration. As shown in FIG. 1, each writing unit 21 includes a light scanner 2*a*, a photoreceptor 2*b*, a developer 2*c*, a charger 2*d*, a cleaner 2*e* and a primary transfer roller 2*f*.

When forming an image, in each writing unit 21, the photoreceptor 2*b* is charged by the charger 2*d* and thereafter, the bundle of light emitted from the light scanner 2*a* scans the photoreceptor 2*b* on the basis of the original image to form an electrostatic latent image. When color material such as toner or the like is supplied by the developer 2*c* and developing is carried out, an image is formed on the photoreceptor 2*b*.

The images formed on the photoreceptors 2*b* of the four writing units 21 are sequentially layered on the intermediate transfer belt 22 (primary transferring) by their corresponding primary transfer rollers 2*f*. In such way, an image formed of colors is formed on the intermediate transfer belt 22. The intermediate transfer belt 22 is an image carrier which rotates by being wound around a plurality of rollers. After the primary transferring, the residual color materials on the photoreceptors 2*b* are removed by the cleaners 2*e*.

In the image forming unit 20, a sheet is fed from the manual feed tray T1 or the sheet feeding trays 25 at the timing when the image on the rotating intermediate transfer belt 22 reaches the position of the pair of secondary transfer rollers 23. With respect to the pair of secondary transfer rollers 23, one roller of the pair presses against the intermediate transfer belt 22 and the other roller is one of the plurality of rollers around which the intermediate transfer belt 22 is wound around. When the image is transferred onto a sheet from the intermediate transfer belt 22 (secondary transferring) by the secondary transfer rollers 23 forming a pair pressing against each other, the sheet is conveyed to the fixing device 24 so that the fixing process is to be carried out thereon and then the sheet is output to the sheet output tray T2. The fixing process is a process to fix the image on the sheet by heating and pressing the sheet with the pair of fixing rollers 241. In the case of forming images on both sides of the sheet, the sheet is conveyed to a reverse path 26 so as to be reversed and then the sheet is fed again to the position of the pair of secondary transfer rollers 23.

When a sheet placed on the manual feed tray T1 is to be fed to the pair of secondary transfer rollers 23, the driving unit 30 makes the upper conveyance roller 34 move upward or downward under the control of the controller 11 so as to make the upper conveyance roller 34 carry out the separating operation from the lower conveyance roller 35 or the pressing against operation to the lower conveyance roller 35.

Next, the sheet conveyance path from the manual feed tray T1 to the pair of secondary transfer rollers 23 will be described with reference to FIG. 3.

On the sheet conveyance path from the manual feed tray T1 to the pair of secondary transfer rollers 23, the pickup roller 31, a pair of sheet feeding rollers formed of a sheet feeding roller 32 and a sorting roller 33 and a pair of conveyance rollers formed of an upper conveyance roller (the first conveyance roller) 34 and a lower conveyance roller (the second conveyance roller) 35 are disposed in this order from the upstream side in the conveyance direction. In the embodiment, a conveyance nip part is formed by the upper conveyance roller 34 and the lower conveyance roller 35 pressing against each other.

The pickup roller 31 picks up the sheets which are placed on the manual feed tray T1 from the position where the sheets are stacked, and sends out the sheets to the pair of sheet feeding rollers (the sheet feeding roller 32 and the sorting roller 33).

The pair of sheet feeding rollers separates the sheets which are sent from the pickup roller 31 one by one and sends the separated sheets to the pair of conveyance rollers (the upper conveyance roller 34 and the lower conveyance roller 35).

The pair of conveyance rollers sends out the sheets which are sent from the pair of sheet feeding rollers or the sheets which are conveyed from the sheet feeding trays 25 via the conveyance path R2 to the pair of secondary transfer rollers 23 via the conveyance path R3. Here, the lower conveyance roller 35 of the pair of conveyance rollers is a driving roller and the upper conveyance roller 34 of the pair is a driven roller.

The sheet conveyance path R1 from the manual feed tray T1 to the pair of conveyance rollers is formed so as to bend in between the pickup roller 31 and the pair of sheet feeding rollers (the sheet feeding roller 32 and the sorting roller 33). In such way, by forming the conveyance path R1 so as to bend right after the pair of sheet feeding rollers and by setting the pair of conveyance rollers after the bending of the conveyance path R1, the size of the apparatus can be small.

The path from the conveyance path R1 to the conveyance path R3 and the path from the conveyance path R2 to the conveyance path R3 are formed so as to bend at the merging point 36 of the conveyance path R1 and the conveyance path R2. That is, the sheet conveyance path R1 from the manual feed tray T1 to the pair of conveyance rollers is formed so as to bend between the pair of sheet feeding rollers (the sheet feeding roller 32 and the sorting roller 33) and the pair of conveyance rollers (the upper conveyance roller 34 and the lower conveyance roller 35). In the present invention, the conveyance paths which are formed so as to bend between the pair of sheet feeding rollers and the pair of conveyance rollers are defined as "bending paths".

Figure 3:
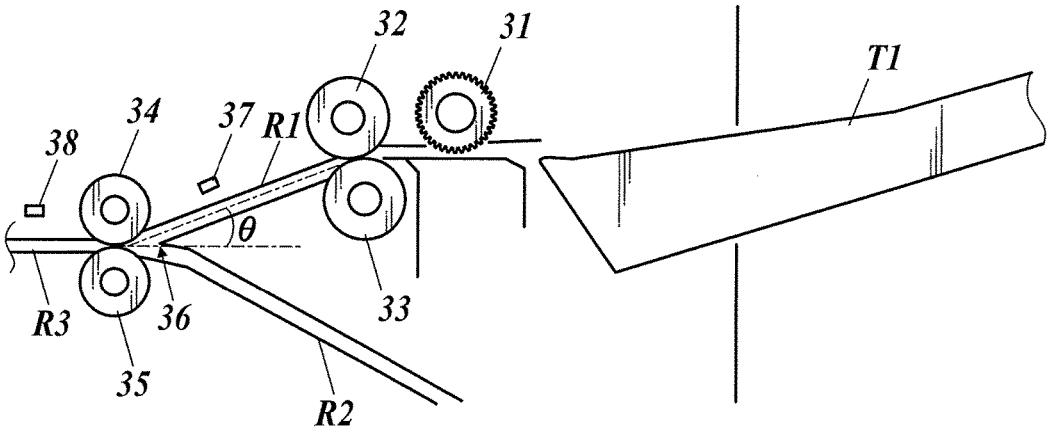
FIG. 3 shows a sheet conveyance path from a manual feed tray to a pair of secondary transfer rollers.

Here, as shown in FIG. 3, the bending angle θ formed by the conveyance path (the first conveyance path) R1 which makes a sheet enter the pair of conveyance rollers and the extended line of the conveyance path (the second conveyance path) R3 which sends out the sheet conveyed from the pair of conveyance rollers is preferably 5° to 30°.

Here, the reason why it is set that $\theta \geq 5°$ is because the apparatus cannot be formed in a small size due to the bending angle being too small if $\theta < 5°$. On the other hand, the reason why it is set that $\theta \leq 30°$ is because the bending angle will be too large if $\theta > 30°$ and a sheet will strongly abut the conveyance guide (not shown in the drawings) near the pair of conveyance rollers, making it difficult to feed the sheet even if the upper conveyance roller 34 is not disposed.

On the conveyance path R1, a sensor (hereinafter, referred to as an upstream sensor) 37 for detecting a sheet which is being conveyed on the conveyance path R1 to the pair of conveyance rollers is disposed just before the merging point 36.

When the upstream sensor 37 detects a sheet which is being conveyed on the conveyance path R1 to the pair of conveyance rollers, the upstream sensor 37 outputs information indicating that the sheet is detected to the controller 11. That is, the upstream sensor 37 functions as the first sheet detector of the present invention.

Further, on the conveyance path R3 which is on the downstream side of the pair of conveyance rollers in the conveying direction, a sensor (hereinafter, referred to as a downstream sensor) 38 for detecting a sheet which is being conveyed on the conveyance path R3 to the pair of secondary transfer rollers 23 is disposed.

When the downstream sensor 38 detects a sheet which is being conveyed on the conveyance path R3 to the pair of secondary transfer rollers 23, the downstream sensor 38 outputs information indicating that the sheet is detected to the controller 11. That is, the downstream sensor 38 functions as the second sheet detector of the present invention.

The sheet feeding apparatus of the present invention at least includes the pair of sheet feeding rollers (the sheet feeding roller 32 and the sorting roller 33), the pair of conveyance rollers (the upper conveyance roller 34 and the lower conveyance roller 35) and the controller 11.

Next, operation of the image forming apparatus G according to the embodiment will be described with reference to FIGS. 4 to 7. The controller 11 receiving an instruction to feed a sheet from the manual feed tray T1 is the trigger to start this operation.

Figure 4:
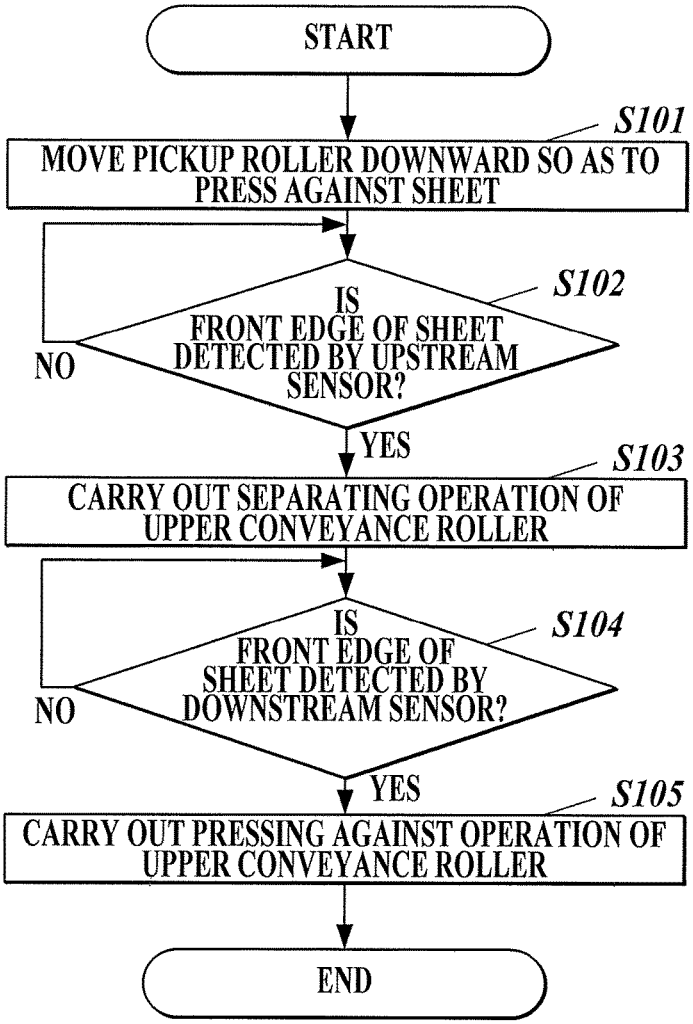
FIG. 4 is a flowchart showing operation of the image forming apparatus according to the embodiment.
Figure 5:
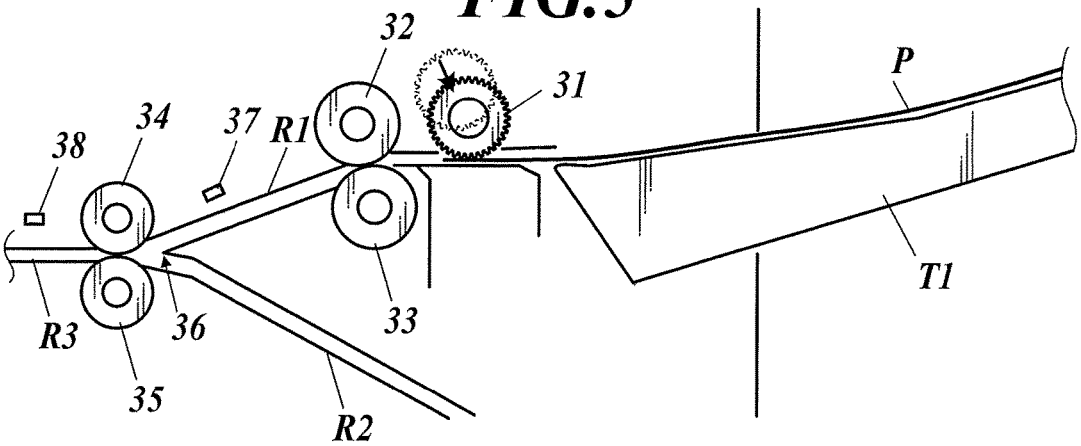
FIG. 5 shows an example operation of making a pickup roller abut a sheet which is placed on the manual feed tray.

First, as shown in the flowchart illustrated in FIG. 4, the controller 11 makes the pickup roller 31 move downward while making it rotate so that the pickup roller 31 abut (press against) a sheet which is placed on the manual feed tray T1 (step S101). FIG. 5 shows an example operation of making the pickup roller 31 abut the sheet P which is placed on the manual feed try T1.

Next, the controller 11 determines whether the front edge of the sheet is detected by the upstream sensor 37 disposed between the pair of sheet feeding rollers and the pair of conveyance rollers (step S102). In step S102, if information indicating that the front edge of the sheet is detected is output from the upstream sensor 37, the controller 11 determines that the front edge of the sheet is detected.

If the controller 11 determines that the front edge of the sheet is detected by the upstream sensor 37 (step S102: YES), the controller 11 proceeds to the next step of step S103.

On the other hand, if the controller 11 determines that the front edge of the sheet is not detected by the upstream sensor 37 (step S102: NO), the controller 11 repeats step S102 until the front edge of the sheet is detected.

Figure 6:
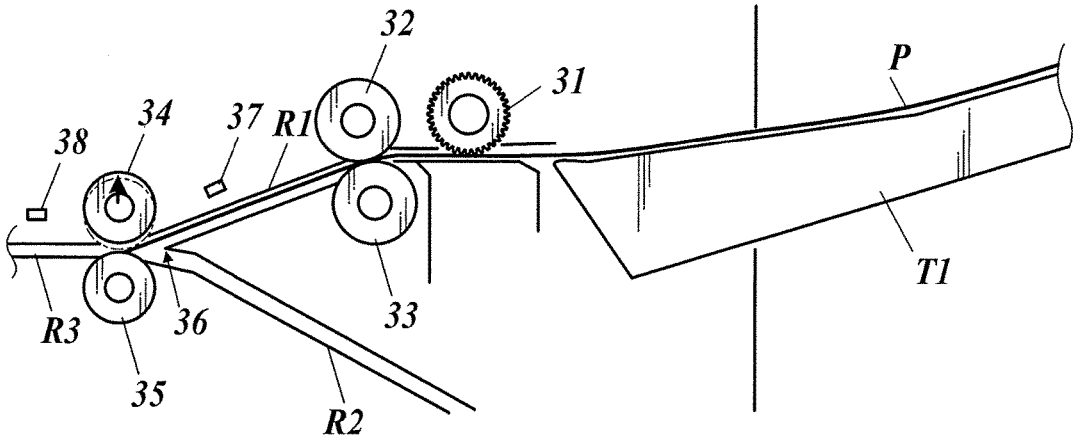
FIG. 6 shows an example operation of making a sheet enter a conveyance nip part in a state where an upper conveyance roller is separated.

Next, the controller 11 controls the driving unit 30 and makes the upper conveyance roller 34 move upward (the separating operation of the upper conveyance roller 34) (step S103). That is, in the embodiment, the first condition regarding the sheet position is that the front edge of the sheet is detected by the upstream sensor 37. By carrying out the separating operation of the upper conveyance roller 34 in step S103, the sheet can be made to enter the conveyance nip part in a state where the nip pressure at the conveyance nip part is reduced. FIG. 6 shows an example operation of making the sheet enter the conveyance nip part in a state where the upper conveyance roller is separated.

Here, the separation amount of the upper conveyance roller 34 is not especially limited. The separation amount may be an amount corresponding to a position inside or outside the conveyance guide (not shown in the drawings) which guides the conveyance of a sheet near the pair of conveyance rollers. For example, in the case where a sheet of super thick paper exceeding 350 gsm is to be fed in the conveyance nip part, it is preferred that the entrance side of the conveyance nip part be wide as much as possible. Therefore, the upper conveyance roller 34 may be separated so as to reach a position completely outside of the conveyance guide.

Next, the controller 11 determines whether the front edge of the sheet is detected by the downstream sensor 38 which is disposed on the downstream side of the pair of conveyance rollers in the conveyance direction (step S104). In step S104, the controller 11 determines that the front edge of the sheet is detected if information indicating that the front edge of the sheet is detected is output from the downstream sensor 38.

If the controller 11 determines that the front edge of the sheet is detected on the basis of the downstream sensor 38 (step S104: YES), the controller 11 proceeds to the next step of step S105.

On the other hand, if the controller 11 determines that the front edge of the sheet is not detected on the basis of the downstream sensor 38 (step S104: NO), the controller 11 repeats the process of step S104 until the front edge of the sheet is detected.

Figure 7:
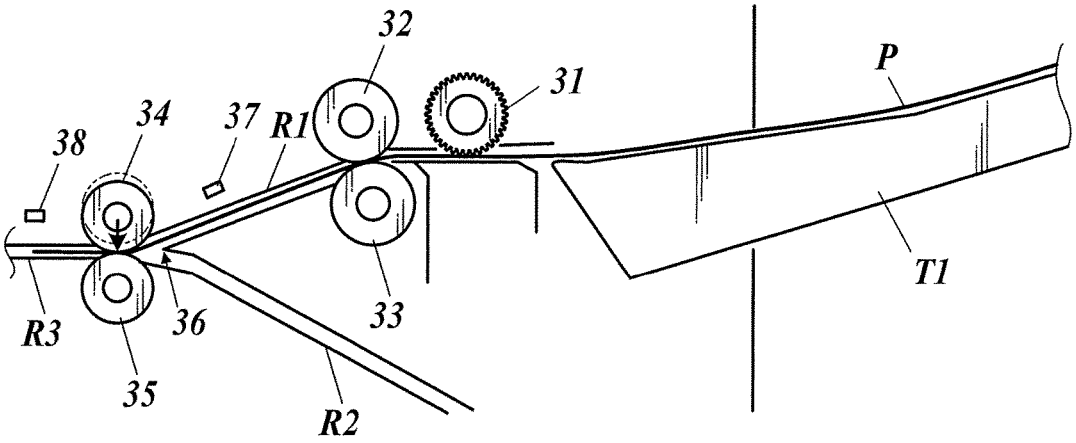
FIG. 7 shows an example of pressing against operation of the upper conveyance roller.

Next, the controller 11 controls the driving unit 30 and makes the upper conveyance roller 34 move downward (the pressing against operation of the upper conveyance roller 34) (step S105). That is, in the embodiment, the second condition regarding the sheet position is that the front edge of the sheet is detected by the downstream sensor 38. By carrying out the pressing against operation of the upper conveyance roller 34 in step S105, the sheet can be conveyed to the pair of second transfer rollers 23 in a state where the nip pressure at the conveyance nip part has returned to the original pressure. FIG. 7 shows an example of the pressing against operation of the upper conveyance roller.

As described above, the image forming apparatus G according to the embodiment includes the pair of sheet feeding rollers (the sheet feeding roller 32 and the sorting roller 33) which sends out a sheet placed on the manual feed tray T1, the pair of sheet feeding rollers being disposed on the upstream side of the bending path in the conveyance direction, the pair of conveyance rollers (the upper conveyance roller 34 and the lower conveyance roller 35) including the first conveyance roller (the upper conveyance roller 34) and the second conveyance roller (the lower conveyance roller 35) which forms the conveyance nip part by the first conveyance roller and the second conveyance roller pressing against each other and which sends out the sheet which is sent from the pair of sheet feeding rollers, the pair of conveyance rollers being disposed on the downstream side of the bending path in the conveyance direction, and the controller 11 which controls feeding of the sheets placed on the manual feed tray T1. Further, when the first condition regarding the sheet position is fulfilled in the sheet feeding, the controller 11 makes one of the first conveyance roller and the second conveyance roller move in the direction opposite to the other conveyance roller and when the second condition regarding the sheet position is fulfilled in the sheet feeding, the controller 11 makes one of the first conveyance roller and the second conveyance roller move in the direction toward the other conveyance roller.

Therefore, according to the image forming apparatus G of the embodiment, the nip pressure at the conveyance nip part formed by the pair of conveyance rollers can be controlled according to the sheet position. Thus, the load caused on a sheet during its conveyance can be reduced and the jamming of sheets can be suppressed even on the conveyance path which is bent. Further, the strength needed for conveying a sheet can be ensured.

Moreover, according to the image forming apparatus G of the embodiment, the bending angle θ which is formed by the first conveyance path (the conveyance path R1) which makes a sheet enter the pair of conveyance rollers and the extended line of the second conveyance path (the conveyance path R3) which sends out the sheet from the pair of conveyance rollers is 5° to 30°.

Therefore, according to the image forming apparatus G of the embodiment, the minimum angle of the bending angle can be ensured. Thus, the apparatus can be formed in a small size. Further, since the bending angle will not be too large, a sheet can softly come in contact with the conveyance guide disposed near the pair of conveyance rollers even if the upper conveyance roller 34 is disposed and degradation in sheet feeding performance can be suppressed.

Furthermore, the image forming apparatus G according to the embodiment includes the first sheet detector (the upstream sensor 37) which detects a sheet, the first sheet detector being disposed on the downstream side of the pair of sheet feeding rollers in the conveyance direction and on the upstream side of the pair of conveyance rollers in the conveyance direction. Further, when the front edge of a sheet is detected by the first sheet detector, the controller 11 makes one of the conveyance rollers move in the direction opposite to the other conveyance roller.

Therefore, according to the image forming apparatus G of the embodiment, it is possible to separate the upper conveyance roller 34 just before the front edge of a sheet reaches the pair of conveyance rollers. Thus, the load caused on a sheet during its conveyance can be reduced for sure.

Moreover, the image forming apparatus G according to the embodiment includes the second sheet detector (the downstream sensor 38) which detects a sheet, the second sheet detector being disposed on the downstream side of the pair of conveyance rollers in the conveyance direction. Further, when the front edge of a sheet is detected by the second sheet detector, the controller 11 makes one of the conveyance rollers move in the direction toward the other conveyance roller.

Therefore, according to the image forming apparatus G of the embodiment, the upper conveyance roller 34 can be made to press against the other conveyance roller again at the timing when the front edge of a sheet passed through the pair of conveyance rollers. Thus, the strength for conveying a sheet can be ensured for sure.

Furthermore, the image forming apparatus G according to the embodiment includes the conveyance guide which guides the conveying of sheets near the pair of conveyance rollers. Further, when the first condition is fulfilled, the controller 11 makes one of the conveyance rollers move in the direction opposite to the other conveyance roller until the conveyance roller which is made to move reaches a position outside the conveyance guide.

Therefore, according to the image forming apparatus G of the embodiment, contact of the separated upper conveyance roller 34 can be suppressed when the front edge of the sheet passes through the pair of conveyance rollers. Thus, the load caused on a sheet during its conveyance can be reduced as much as possible.

In the above, a specific description is made on the basis of the embodiment of the present invention. However, the present invention is not limited to the above described embodiment and modifications can be made within the scope of the invention.

For example, in the above described embodiment, the configuration in which the upper conveyance roller 34 is made to move upward and downward is exemplified and described. However, this is not limitative in any way. For example, as shown in FIGS. 8 and 9, the configuration in which the lower conveyance roller 35 is made to move upward and downward instead of the upper conveyance roller 34 can be adopted.

Figure 8:
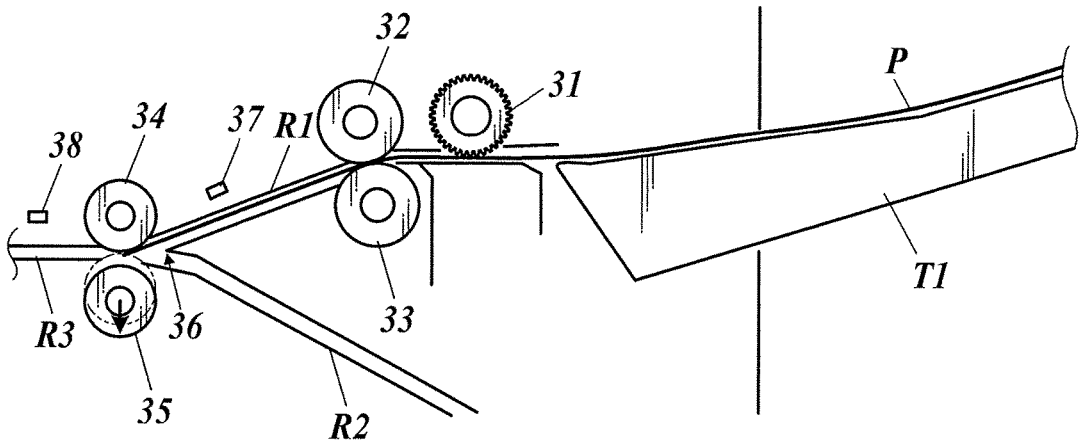
FIG. 8 shows an example operation of making a sheet enter the conveyance nip part in a state where a lower conveyance roller is separated.
Figure 9:
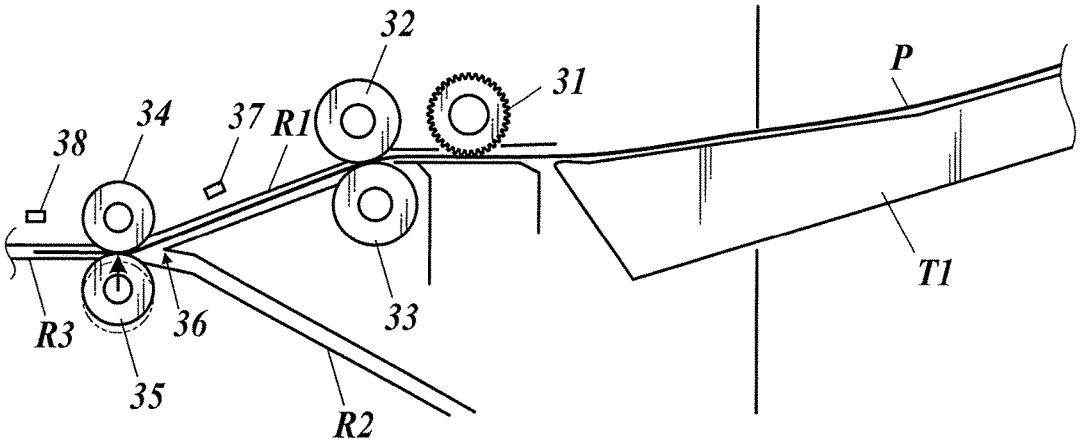
FIG. 9 shows an example of pressing against operation of the lower conveyance roller.

FIG. 8 shows an example operation of making a sheet enter the conveyance nip part in a state where the lower conveyance roller 35 is separated. FIG. 9 shows an example of pressing against operation of the lower conveyance roller 35.

Moreover, in the above described embodiment, the lower conveyance roller 35 of the pair of conveyance rollers is the driving roller and the upper conveyance roller 34 of the pair of conveyance rollers is the driven roller. However, this is not limitative in any way. For example, the upper conveyance roller 34 may be the driving roller and the lower conveyance roller 35 may be the driven roller.

Here, when seen from the view point of sheet conveyance performance, it is preferred that the driven roller is made to move upward and downward.

Furthermore, in the above described embodiment, detection of the front edge of a sheet by the upstream sensor 37 is described as an example of the first condition regarding the sheet position for carrying out the separating operation of the upper conveyance roller 34. However, this is not limitative in any way. For example, as for the first condition regarding the sheet position, detection of the rear edge of a sheet by the downstream sensor 38 may be adopted.

As described above, by carrying out the separating operation of the upper conveyance roller 34 when the rear edge of a sheet is detected by the downstream sensor 38, the upper conveyance roller 34 can separate from the other conveyance roller at the timing just before the front edge of a sheet enters the pair of conveyance rollers even if the upstream sensor 37 is not disposed. Thus, the load caused on a sheet during its conveyance can be reduced.

Moreover, in the above described embodiment, detection of the front edge of a sheet by the downstream sensor 38 is described as an example of the second condition regarding the sheet position for carrying out the pressing against operation of the upper conveyance roller 34. However, this is not limitative in any way. For example, as for the second condition regarding the sheet position, elapsing of a predetermined time period after the front edge of a sheet is detected by the upstream sensor 37 may be adopted. Here, a predetermined time period is the time period when it can be assumed that the front edge of a sheet is detected by the downstream sensor 38 if the normal sheet conveyance is carried out, for example.

As described above, by carrying out the pressing against operation of the upper conveyance roller 34 when the predetermined time period has elapsed after the front edge of a sheet is detected by the upstream sensor 37, the upper conveyance roller 34 can be made to press against the other conveyance roller again at the timing when the front edge of a sheet passed through the pair of conveyance rollers even if the downstream sensor 38 is not disposed. Thus, the strength for conveying the sheet can be ensured.

Further, in the above described embodiment, the configuration in which the upper conveyance roller 34 is made to move upward and downward unconditionally when the sheet feeding instruction is received from the manual feed tray T1 is exemplified and described. However, this is not limitative in any way. For example, the configuration in which the upper conveyance roller 34 is made to move upward and downward when a sheet fulfills a predetermined sheet type condition may be adopted.

FIG. 10 shows an example of the table in which the sheet type conditions of sheets (sheet type, basis weight) and whether the pressing/separating operation of the upper conveyance roller 34 is to be carried out are corresponding to each other. Here, in the example shown in FIG. 10, whether the pressing/separating operation is to be carried out is determined in three levels, that are "○=the operation is carried out", "Δ=a user can select whether to carry out the operation" and "×=the operation is not carried out".

As shown in FIG. 10, with respect to whether the pressing/separating operation is to be carried out, if the sheet is "regular paper", it is determined to be "×" when its basis weight is "64 to 176 gsm", it is determined to be "Δ" when its basis weight is "177 to 300 gsm" and it is determined to be "○" when its basis weight is "301 to 450 gsm". Further, if the sheet is "coated paper", it is determined to be "×" when its basis weight is "64 to 176 gsm", it is determined to be "Δ" when its basis weight is "177 to 256 gsm" and it is determined to be "○" when its basis weight is "257 to 450 gsm".

That is, in the example shown in FIG. 10, in both cases where the sheet is "regular paper" and where the sheet is "coated paper", the greater the basis weight of the sheet, the more likely the pressing/separating operation of the upper conveyance roller 34 is to be carried out.

Here, the sheet type conditions of sheets are not limited to the sheet type and basis weight and the conditions may be the rigidity, surface condition and the like of the sheets.

As described above, by carrying out the pressing/separating operation of the upper conveyance roller 34 when a sheet fulfills a predetermined sheet type condition, the pressing/separating operation can be carried out only for a sheet having the sheet type condition which is assumed to require the reduction of the load caused on the sheet during its conveyance. Thus, reduction in productivity can be suppressed.

Further, in the above described embodiment, the configuration in which the upper conveyance roller 34 is separated from the lower conveyance roller 35 is exemplified and described. However, this is not limitative in any way. For example, the configuration in which the upper conveyance roller 34 is made to raise to the extent that it does not separate from the lower conveyance roller 35, that is, to the extent where the upper conveyance roller 34 maintains its contact with the lower conveyance roller 35 so as to reduce the pressure applied to the lower conveyance roller 35 from the upper conveyance roller 34 may be adopted.

As described above, by reducing the pressure applied to the lower conveyance roller 35 from the upper conveyance roller 34, the movement amount of the upper conveyance roller 34 can be controlled to be small. Thus, the operating time needed for controlling the nip pressure of the pair of conveyance rollers can be reduced and reduction in productivity can be suppressed.

Moreover, in the case where the configuration in which the pressure applied to the lower conveyance roller 35 from the upper conveyance roller 34 is reduced is adopted, the reduction amount of the pressure applied to the lower conveyance roller 35 from the upper conveyance roller 34 can further be determined on the basis of the sheet type condition of a sheet.

FIG. 11 shows an example of the table where the sheet type conditions (paper type, basis weight), whether the upward and downward movement of the upper conveyance roller 34 is to be carried out and the raising level of the upper conveyance roller 34 at the time of the upward and downward movement thereof are corresponding to each other. Here, in the example shown in FIG. 11, whether the upward and downward movement is to be carried out is determined in three levels, that are "○=the movement is carried out", "Δ=a user can select whether to carry out the movement" and "×=the movement is not carried out". Further, the raising level of the upper conveyance roller 34 is determined in three levels, that are "small amount of pressure reduction", "large amount of pressure reduction" and "completely separated".

As shown in FIG. 11, with respect to whether the upward and downward movement is to be carried out, if the sheet is "regular paper", it is determined to be "×" when its basis weight is "64 to 176 gsm", it is determined to be "Δ" when its basis weight is "177 to 300 gsm" and it is determined to be "○" when its basis weight is "301 to 450 gsm". Further, if the sheet is "coated paper", it is determined to be "×" when its basis weight is "64 to 176 gsm", it is determined to be "Δ" when its basis weight is "177 to 256 gsm" and it is determined to be "○" when its basis weight is "257 to 450 gsm".

Further, with respect to the raising level of the upper conveyance roller 34 at the time of the upward and downward movement thereof, in both cases where the sheet is "regular paper" and where the sheet is "coated paper", it is determined to be "small amount of pressure reduction" when the basis weight is "177 to 216 gsm", it is determined to be "large amount of pressure reduction" when the basis weight is "217 to 256 gsm" and it is determined to be "completely separated" when the basis weight is "257 to 450 gsm".

That is, in the example shown in FIG. 11, in both cases where the sheet is "regular paper" and where the sheet is "coated paper", the greater the basis weight of the sheet, the more likely the upward and downward movement of the upper conveyance roller 34 is to be carried out. Further, in both cases where the sheet is "regular paper" and where the sheet is "coated paper", the greater the basis weight of the sheet, the greater the raising level of the upper conveyance roller 34.

As described above, by determining the reduction amount of the pressure applied to the lower conveyance roller 35 from the upper conveyance roller 34 on the basis of the sheet type condition of a sheet, the pressure of the nip at the pair of conveyance rollers can be controlled in a fine manner according to the need for reducing the load caused on the sheet during its conveyance. Thus, the load caused on a sheet during its conveyance can be reduced and the productivity can be ensured in a compatible manner in good balance.

In addition, with respect to the detail configuration of individual devices forming the image forming apparatus and the detail operation of the individual devices, they can also be modified as needed within the scope of the invention.

According to an aspect of a preferred embodiment of the present invention, there is provided a sheet feeding apparatus, including: a pair of sheet feeding rollers which is disposed on an upstream side of a bending path in a conveyance direction and sends out a sheet that is placed on a manual feed tray; a pair of conveyance rollers which is disposed on a downstream side of the bending path in the conveyance direction, includes a first conveyance roller and a second conveyance roller, and forms a conveyance nip part by making the first conveyance roller and the second conveyance roller press against each other and sends out the sheet which is sent from the pair of sheet feeding rollers; and a controller which controls sheet feeding of the sheet that is placed on the manual feed tray, wherein when a first condition regarding a sheet position is fulfilled in the sheet feeding, the controller makes one of the first conveyance roller and the second conveyance roller move in a direction opposite to the other conveyance roller and when a second condition regarding the sheet position is fulfilled in the sheet feeding, the controller makes the one conveyance roller move in a direction toward the other conveyance roller.

Such a sheet feeding apparatus can suppress the occurrence of paper jams by reducing the load caused on a sheet during its conveyance and ensure the sheet conveyance strength even on a conveyance path which is bent.

Although embodiments of the present invention have been described and illustrated in detail, it is clearly understood that the same is by way of illustration and example only and not limitation, the scope of the present invention should be interpreted by terms of the appended claims.

Japanese Patent Application No. 2016-176740 filed on Sep. 9, 2016, including description, claims, drawings, and abstract the entire disclosure is incorporated herein by reference in its entirety.

What is claimed is:

1. A sheet feeding apparatus, comprising:

a pair of sheet feeding rollers which is disposed on an upstream side of a bending path in a conveyance direction and sends out a sheet that is placed on a manual feed tray;

a pair of conveyance rollers which is disposed on an immediate downstream side of the bending path in the conveyance direction, includes a first conveyance roller and a second conveyance roller, and forms a conveyance nip part by making the first conveyance roller and the second conveyance roller press against each other and sends out the sheet which is sent from the pair of sheet feeding rollers;

a controller which controls sheet feeding of the sheet that is placed on the manual feed tray; and at least one sheet detector configured to detect a position of the sheet and output information, to the controller, indicating detection of the sheet, wherein (i) when a first condition regarding a sheet position detected by the at least one sheet detector is fulfilled in the sheet feeding, the controller makes one of the first conveyance roller and the second conveyance roller move in a direction away from the other conveyance roller, wherein said first condition is a state before the sheet reaches the pair of conveyance rollers, and (ii) when a second condition regarding the sheet position detected by the at least one sheet detector is fulfilled in the sheet feeding, the controller makes the one conveyance roller move in a direction toward the other conveyance roller, wherein the second condition is a state in which the sheet has reached the pair of conveyance rollers.

2. The sheet feeding apparatus of claim 1, wherein a bending angle θ formed by a first conveyance path on which the sheet enters the pair of conveyance rollers and an extended line of a second conveyance path on which the sheet is sent out from the pair of conveyance rollers is 5° to 30°.

3. The sheet feeding apparatus of claim 1, wherein the at least one sheet detector includes a sheet detector which is disposed on the downstream side of the pair of sheet feeding rollers in the conveyance direction and on the upstream side of the pair of conveyance rollers in the conveyance direction and detects the sheet, and when a front edge of the sheet is detected by the sheet detector, the controller makes the one conveyance roller move in the direction away from the other conveyance roller.

4. The sheet feeding apparatus of claim 1, wherein the at least one sheet detector includes a sheet detector which is disposed on the downstream side of the pair of conveyance rollers in the conveyance direction and detects the sheet, and wherein when a rear edge of the sheet is detected by the sheet detector, the controller makes the one conveyance roller move in the direction away from the other conveyance roller.

5. The sheet feeding apparatus of claim 1, wherein the at least one sheet detector includes a sheet detector which is disposed on the downstream side of the pair of conveyance rollers in the conveyance direction and detects the sheet, and wherein when a front edge of the sheet is detected by the sheet detector, the controller makes the one conveyance roller move in the direction toward the other conveyance roller.

6. The sheet feeding apparatus of claim 1, wherein the at least one sheet detector includes a sheet detector which is disposed on the downstream side of the pair of sheet feeding rollers in the conveyance direction and on the upstream side of the pair of conveyance rollers in the conveyance direction and detects the sheet, wherein when a predetermined time period elapses after a front edge of the sheet is detected by the sheet detector, the controller makes the one conveyance roller move in the direction toward the other conveyance roller.

7. The sheet feeding apparatus of claim 1, wherein the controller makes one of the first conveyance roller and the second conveyance roller move based on a predetermined sheet type condition.

8. The sheet feeding apparatus of claim 1, wherein when the first condition is fulfilled, the controller reduces a pressure applied to the other conveyance roller from the one conveyance roller.

9. The sheet feeding apparatus of claim 8, wherein the controller determines a reduction amount of the pressure applied to the other conveyance roller from the one conveyance roller based on a predetermined sheet type condition.

10. The sheet feeding apparatus of claim 1, further comprising a conveyance guide which guides conveying of the sheet near the pair of conveyance rollers, wherein when the first condition is fulfilled, the controller makes the one conveyance roller move in the direction away from the other conveyance roller until the one conveyance roller reaches a position outside the conveyance guide.

11. An image forming apparatus, comprising:

the sheet feeding apparatus of claim 1 which feeds the sheet that is placed on the manual feed tray, and an image former which forms an image on the sheet which is fed by the sheet feeding apparatus.

* * * * *